US005829088A

United States Patent [19]

Ujihara et al.

[11] Patent Number: 5,829,088

[45] Date of Patent: Nov. 3, 1998

[54] SWAB FOR WIPING CONDENSATE FROM INNER WALL OF WIND INSTRUMENT

[75] Inventors: Tatsuya Ujihara; Hiroshi Kenmochi, both of Shizuoka, Japan

[73] Assignee: Yamaha Corporation, Japan

[21] Appl. No.: 694,158

[22] Filed: Aug. 8, 1996

[30] Foreign Application Priority Data

Aug. 10, 1995 [JP] Japan ..... 7-204322

[51] Int. Cl.[6] ..... G10G 7/00; A47L 25/12; A47K 7/02

[52] U.S. Cl. ..... 15/211; 15/104.16; 84/453

[58] Field of Search ..... 15/104.16, 104.165, 15/210.1, 211, 212; 84/453

[56] References Cited

U.S. PATENT DOCUMENTS

| | | | |
|---|---|---|---|
| 878,768 | 2/1908 | Callahan | 15/211 |
| 2,537,149 | 1/1951 | McKean et al. . | |
| 3,739,420 | 6/1973 | Kafkis . | |
| 5,171,925 | 12/1992 | Mekler | 15/104.165 |
| 5,212,332 | 5/1993 | Gigliotti . | |
| 5,555,588 | 9/1996 | Viesehon | 15/104.16 |

FOREIGN PATENT DOCUMENTS

| | | | |
|---|---|---|---|
| 612055 | 8/1994 | European Pat. Off. . | |
| 3715490 | 11/1988 | Germany | 84/453 |
| 2182191 | 5/1987 | United Kingdom . | |

*Primary Examiner*—Terrence Till
*Attorney, Agent, or Firm*—Ostrolenk, Faber, Gerb & Soffen, LLP

[57] ABSTRACT

A piece of hygroscopic cloth is connected to a flexible string formed of non-hygroscopic material such as nylon for wiping condensate from an inner surface of a crook, and the flexible string advances through an air passage of the crook without clinging to the inner surface, thereby making wiping away the condensate easy.

11 Claims, 4 Drawing Sheets

SWAB FOR WIPING CONDENSATE FROM INNER WALL OF WIND INSTRUMENT

FIELD OF THE INVENTION

This invention relates to a swab used for a musical instrument and, more particularly, to a swab for wiping condensate from the inner wall of a wind instrument.

DESCRIPTION OF THE RELATED ART

While a player is breathing into a wind instrument, the column of air vibrates inside of the wind instrument, and the vibration is radiated from the wind instrument as sounds. However, the breath is warm and wet, containing water vapor which tends to condense on the inner wall of the wind instrument. The condensate is usually wiped away with a swab after the performance.

The wind instrument has various structure, and is usually broken down into tubular pieces. The air passages of the tubular pieces are usually not constant. For example, a crook and a bell joint are indispensable tubular pieces of a bassoon. The air passages of the crook is several millimeters, and the bell joint defines an air passage as wide as several centimeters. Most of the other wind instruments are analogous, and the wiping away of condensate for a narrow air passage is not easy.

FIG. 1 illustrates a crook 1 of a bassoon. The crook 1 is gently curved, and defines an air passage 1*a*. The air passage 1*a* is decreased from a blowing end 1*b* toward a connecting end 1*c*, and a double reed (not shown) is attached to the blowing end 1*b*. A player blows into the crook 1, and the breath causes the double reed to vibrate. The air passage guides the air flow to the next tubular piece called a tenor joint. The water vapor of the breath is condensed on the inner surface of the crook.

After the performance, the player usually wipes the condensate from the inner surface of the crook 1 with a swab. The prior art swab 2 is illustrated in FIG. 2, and comprises a square piece 2*a* of hygroscopic cloth, a guide string 2*b* sewed on the square piece 2*a* and a guide weight 2*c* attached to the leading end of the guide string 2*b*. The guide string 2*b* is formed from cotton yarn or artificial silk yarn, and is sewed along a diagonal line 2*d* of the square piece 2*a*. The guide weight 2*c* is elongated, and is thin enough to pass the narrow air passage at the connecting end 1*c*. The guide weight 2*c* is not so heavy.

When the player wipes the condensate from the inner wall of the crook 1, the crook 1 is disassembled from the tenor joint (not shown), and the player keeps the crook 1 in the position where the blowing end 1*b* is upwardly directed. The player picks up the guide weight 2*c*, and drops the guide weight 2*c* into the air passage at the blowing end 1*b*. The player moves the crook 1 so that the guide weight 2*c* slides on the inner wall of the crook 1, and the guide string 2*b* follows the guide weight 2*c*. The player takes the guide weight 2*c* from the connecting end 1*c*, and pulls out the guide weight 2*c*. The guide string 2*b* and, accordingly, the square piece 2*a* of hygroscopic cloth proceed through the air passage toward the connecting end 1*c*, and the condensate is wiped away from the inner wall of the crook 1 with the square piece 2*a* of hygroscopic cloth.

Another prior art swab 3 is illustrated in FIG. 3, and is different from the prior art swab 2 in the shape of the hygroscopic cloth. The prior art swab 3 also comprises a triangle piece 3*a* of hygroscopic cloth, a guide string 3*b* sewed along the perpendicular line 3*c* of the triangle piece 3*a* and a guide weight (not shown) attached to the leading end of the guide string 3*b*. A player uses the prior art swab 3 in a similar manner to the prior art swab 2.

However, a problem is encountered in the prior art swabs 2 and 3 in that the crook 1 is liable to be clogged with the swabs 2 and 3.

Another problem inherent in the prior art swabs 2 and 3 is difficulty of taking out the wet square/triangle piece 2*a*/3*a* from the crook 1.

The present inventors contemplated the first problem, and noticed that the guide weight 2*c* was too light to pull the guide string 2*b*/3*b* clinging to the wet inner surface of the crook 1. While the guide weight 2*c* and the guide string 2*b*/3*b* were slowly advancing through the air passage 1*a*, the square/triangle piece 2*a*/3*a* of hygroscopic cloth absorbed the condensate, and became heavy. The light guide weight 2*c* could not pull the heavy wet square/triangle piece 2*a*/3*a*, and the crook was clogged.

If a heavy guide weight effective against the clog was attached to the leading end of the guide string 2*b*/3*b*, the heavy guide weight per se clogged the air passage, because such a heavy guide weight was too large to pass the narrow air passage 1*a* at the connecting end.

SUMMARY OF THE INVENTION

It is therefore an important object of the present invention to provide a swab which smoothly passes through a piece of tubular member of a wind instrument.

To accomplish the object, the present invention proposes to form a thin guide member of flexible non-hygroscopic material. While a player is thrusting the thin guide member into an air passage, the thin guide member can propagate the thrust to the leading end portion thereof; however, the thin guide member deforms the shape thereof along the inner wall defining the air passage, and the leading end of the guide member advanced toward the other end of the air passage.

In accordance with the present invention, there is provided a swab for wiping condensate from an inner surface of a tubular member forming a part of a wind instrument, comprising: a piece of hygroscopic material insertable into an inner space of the tubular member; a flexible guide member deformable along an inner wall of the tubular member defining the inner space when the flexible guide member is thrust into the inner space; and a coupling member for fixing the piece of hygroscopic material to one end of the flexible tenacious guide member.

BRIEF DESCRIPTION OF THE DRAWINGS

The features and advantages the swab according to the present invention will be more clearly understood from the following description taken in conjunction with the accompanying drawings in which.

DESCRIPTION OF THE PREFERRED EMBODIMENT

Figure 1:
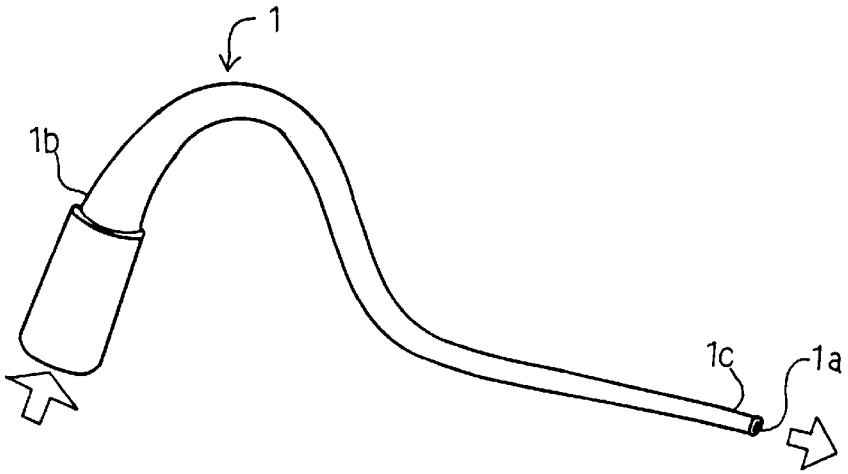
Fig. 1 PRIOR ART
FIG. 1 is a perspective view showing the crook of the standard bassoon.
Figure 2:
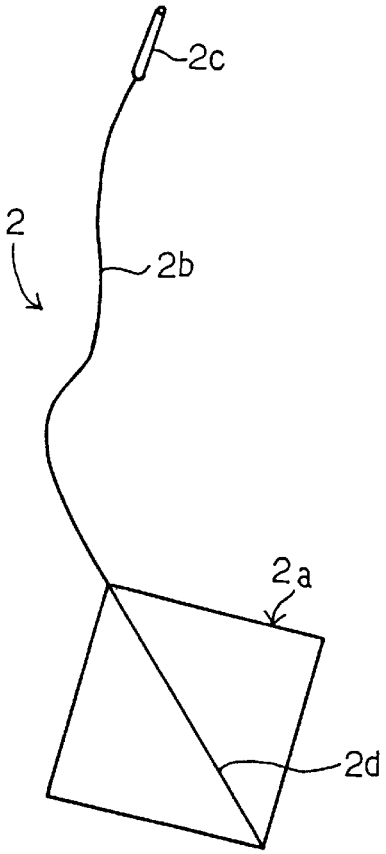
Fig. 2 PRIOR ART
FIG. 2 is a perspective view showing the prior art swab used for the crook.
Figure 3:
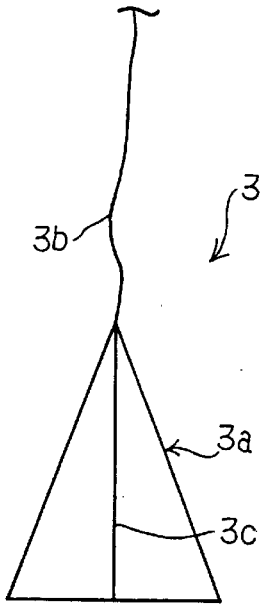
Fig. 3 PRIOR ART
FIG. 3 is a perspective view showing another prior art swab.
Figure 4:
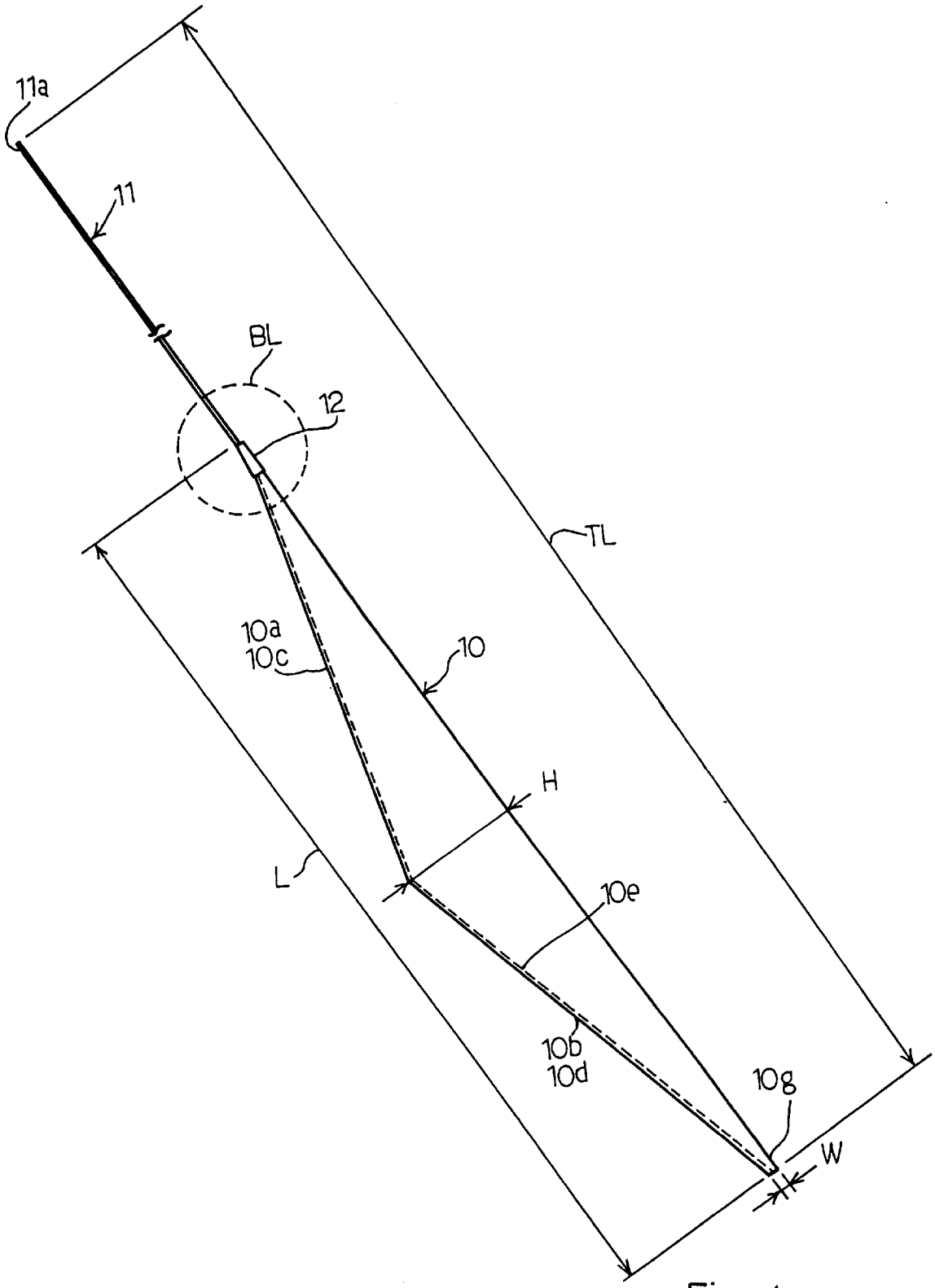
FIG. 4 is a front view showing a swab for a wind instrument according to the present invention.

Referring to FIG. 4 of the drawings, a swab embodying the present invention comprises a piece 10 of hygroscopic cloth, a flexible guide string 11 and a coupling member 12 for connecting the piece of hygroscopic cloth 10 to the flexible guide string 11.

The piece 10 of hygroscopic cloth is formed from cotton fiber, silk fiber, hemp yarn, artificial silk fiber, nylon fiber, polyester fiber, a commingle yarn of nylon and polyester. A piece of non-woven hygroscopic fabric and a sheet of hygroscopic paper are available for the swab according to the present invention.

The piece 10 of hygroscopic cloth is shaped into a generally rhombic configuration, and is folded back along a long center line so as to overlap the two edges 10*a* and 10*b* with the other two edges 10*c* and 10*d,* respectively. The halves of the piece 10 are sewed with a string 10*e* along the edges 10*a*/10*c* and 10*b*/10*d,* and the piece 10 of hygroscopic cloth is shaped into a generally isosceles triangle. Two holes are formed at both ends of the base of the generally isosceles triangle shaped hygroscopic cloth 10. The width W ranges from 5 millimeters to 10 millimeters, and the ratio between the length L and the height H falls within the range from 5:1 to 30:1. The length L and the height are dependent on the air passage of a tubular member from which the swab wipes condensate.

The flexible guide string 11 has a diameter ranging from 1 millimeter to 2 millimeter, and is formed of flexible material having sufficient rigidity so that the flexible guide string maintains its shape under no load conditions but deforms to the curvation of the air passage when it is inserted therein. The rigidity allows the flexible guide string 11 to withstand thrust exerted thereon during wiping, and the flexible guide string 11 advances along an air passage without forming a coil. Non-hygroscopicity is another desirable property for the flexible guide string 11, because hygroscopic material is liable to lose its rigidity. For this reason, the flexible guide string 11 is formed of nylon, polypropylene, polyethylene or chloroethylene, and a vinyl coated flexible metal wire is available for the flexible guide string 11. Especially, the nylon string is desirable, because a manufacturer can purchase it from a commercial market at a reasonable price.

Figure 5:
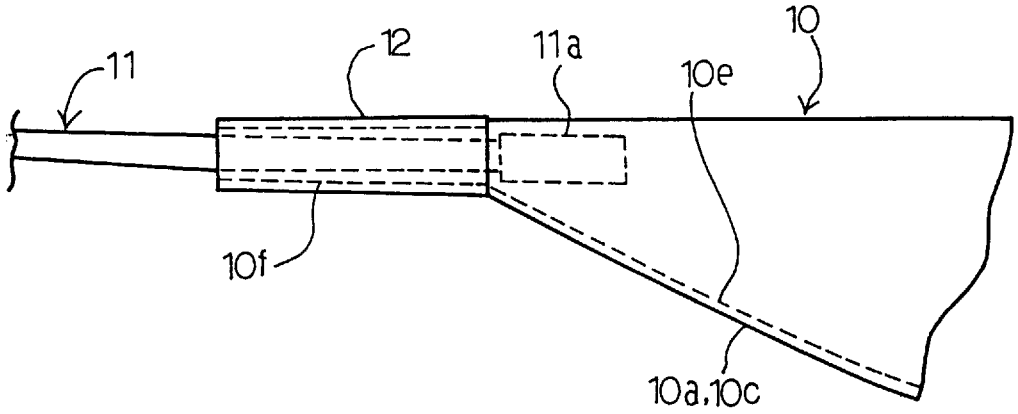
FIG. 5 is a front view showing a coupling incorporated in the swab.

FIG. 5 shows the coupling member 12 encircled in broken lines BL in FIG. 4. One end portion 11*a* of the flexible guide string 11 is inserted into the inner space of the generally isosceles triangle shaped hygroscopic cloth 10 through the hole formed at a leading end portion thereof. The coupling member 12 is implemented by a synthetic resin tube, and the leading end portion of the generally isosceles triangle shaped hygroscopic cloth 10 is inserted into the synthetic resin tube 12 together with the flexible guide string 11. The synthetic resin tube is caulked. Then, the synthetic resin tube presses the leading end portion 10*f* of the generally isosceles triangle shaped hygroscopic cloth 10 against the outer surface of the flexible guide string 11, and fixes the generally isosceles triangle shaped hygroscopic cloth 10 to the flexible guide string 11. Thus, the generally isosceles triangle shaped hygroscopic cloth 10 is connected to the flexible guide string 11 by means of the synthetic resin tube or the coupling member 12.

In this instance, the total length TL of the flexible guide string 11 and the generally isosceles triangle shaped hygroscopic cloth 10 is longer than an air passage 13*a* of a crook 13 (see FIGS. 6A to 6C), because a trailing end portion 10*g* of the generally isosceles triangle shaped hygroscopic cloth 10 should be outside of the blowing end portion 13*b* when the leading end 11*a* of the flexible guide string 11 reaches the connecting end 13*c* of the crook 13. However, another swab according to the present invention is shorter than an air passage, because the flexible guide string may be taken out from an intermediate portion of the air passage.

Figure 6A:
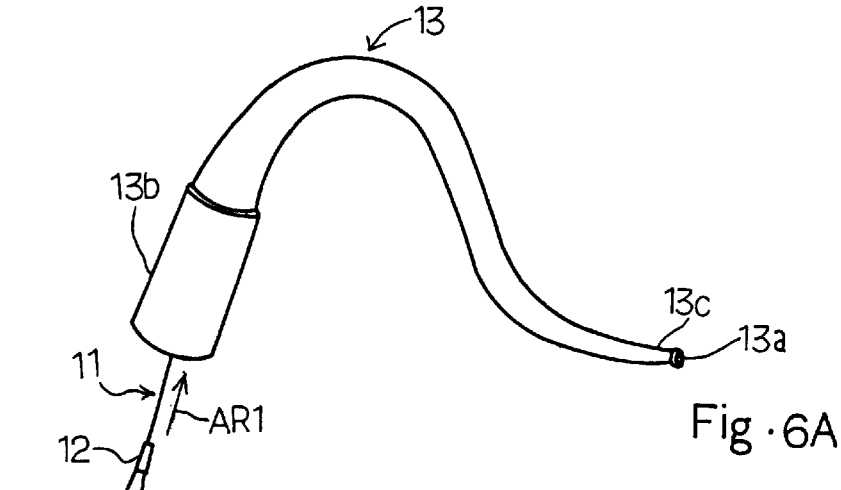
FIGS. 6A to 6C are perspective view showing wiping away condensate with the swab according to the present invention.

Subsequently, description is hereinbelow made of wiping condensate from the crook 13 forming a part of a bassoon with reference to FIGS. 6A to 6C.

First, the swab shown in FIG. 4 is prepared. A worker puts the leading end portion 11*a* of the flexible guide string 11 into the air passage 13*a* at the blowing end portion 13*b,* and thrusts the flexible guide string 11 into the air passage 13*a* as indicated by arrow AR1 (see FIG. 6A). The flexible guide string 11 well withstands the bending moment due to the thrust, and propagates the thrust to the leading end 11*a*. For this reason, a weight is not necessary for the swab according to the present invention.

The tenacity of the flexible guide string 11 is so large that the thrust causes the flexible guide string 11 to advance along the air passage 13*a* of the crook 13 toward the connecting end 13*c* without forming a coil. Even though the inner surface of the crook 13 is wet with condensate, the non-hygroscopic flexible guide string 11 slides on the wet inner surface of the crook 13 without loosing its rigidity. Moreover, the non-hygroscopicity prevents the flexible guide string 11 from clinging to the inner wall of the crook 13. When the flexible guide string 11 passes a curved portion of the air passage 13*a,* the flexible guide string 11 is deformed.

Figure 6B:
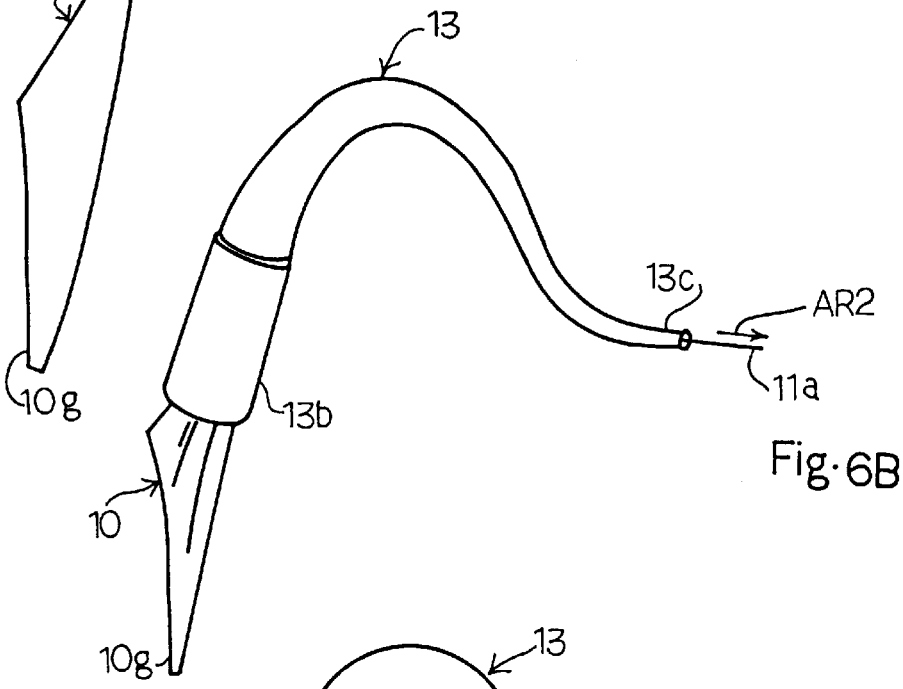
Figure 6C:
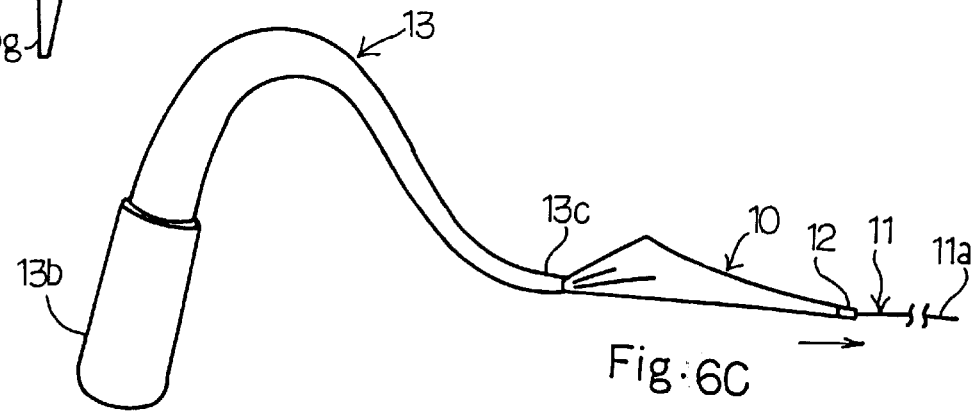

When the leading end portion 11*a* reaches the connecting end 13*c* of the crook 13, the worker picks up the leading end portion 11*a,* and pulls the flexible guide string 11 as indicated by arrow AR2 (see FIG. 6B). The generally isosceles triangle shaped hygroscopic cloth 10 follows the flexible guide string 11, and advances along the air passage 13*a* toward the connecting end 13*c.* While the generally isosceles triangle shaped hygroscopic cloth 10 is passing through the air passage 13*a,* the condensate is absorbed by the generally isosceles triangle shaped hygroscopic cloth 10, and is wiped from the inner surface of the crook 13. The generally isosceles triangle shaped hygroscopic cloth 10 is taken out from the connecting end 13*c* as shown in FIG. 6C.

The generally isosceles triangle shaped hygroscopic cloth 10 is widely shrunk depending upon the air passage 13*a,* because the piece of hygroscopic cloth is sewed into a tube-like configuration. Moreover, the generally isosceles triangle shaped hygroscopic cloth 10 is less liable to be twisted in the air passage 13*a* by virtue of the tube-like configuration and the ratio between the length L and the height H. Thus, the air passage 13*a* is hardly clogged with the swab according to the present invention.

Even if the generally isosceles triangle shaped hygroscopic cloth 10 is coiled in the air passage 13*a* before the leading end 11*a* reaches the connecting end 13*c,* the trailing end 10*g* is still outside of the blowing end portion 13*b* (see FIG. 6B), and the worker can easily pull the trailing end 11*g* back.

As will be appreciated from the foregoing description, the swab according to the present invention passes through an air passage without clog by virtue of the flexible tenacious guide string 11. The tube-like generally isosceles triangle shaped hygroscopic cloth 10 is less liable to be twisted in the air passage, and causes the swab according to the present invention to smoothly pass through the air passage.

Moreover, when the total length TL is longer than the air passage 13*a,* the worker can pull the generally isosceles triangle shaped hygroscopic cloth 10 back, and the air passage is easily recovered from the clog.

Although particular embodiments of the present invention have been shown and described, it will be obvious to those skilled in the art that various changes and modifications may be made without departing from the spirit and scope of the present invention.

For example, the piece of hygroscopic cloth may be shaped into a bundle of strings, a ribbon or a braid. The swab shown in FIG. 4 may be modified in size so as to use in another wind instrument.

What is claimed is:

1. A swab for wiping condensate from an inner surface of a tubular member forming a part of a wind instrument, comprising:

a piece of hygroscopic material insertable into an inner space of said tubular member;

a flexible guide member deformable along an inner wall of said tubular member defining said inner space when said flexible guide member is thrust into said inner space; and a coupling member for fixing said piece of hygroscopic material to one end of said flexible guide member, said piece of hygroscopic material being a piece of cloth sewed into a tube-like configuration, and a trailing end of said flexible guide member being inserted into an inner space at a leading end portion of said piece of hygroscopic material so as to be fixed to said leading end portion of said piece of hygroscopic material by means of said coupling member.

2. The swab as set forth in claim 1, in which said flexible tenacious guide member is shaped into a string allowed to pass through said inner space, and said piece of hygroscopic material is spreadable so as to be wider than said inner space.

3. The swab as set forth in claim 2, in which said inner space has opposed open ends and the total length of said flexible tenacious guide member and said piece of hygroscopic material coupled to said flexible tenacious guide member by means of said coupling member is larger than a distance between both open ends of said inner space so that a part of said piece of hygroscopic material is outside of one of both ends of said inner space when a leading end of said flexible guide member reaches the other of both ends of said inner space.

4. The swab as set forth in claim 1, in which said tenacious guide member has non-hygroscopicity.

5. The swab as set forth in claim 4, in which said flexible guide member is shaped into a string.

6. The swab as set forth in claim 4, in which said flexible guide member is formed of a substance selected from the group consisting of nylon, polypropylene, polyethylene and chloroethylene or from a vinyl coated flexible metal wire.

7. The swab as set forth in claim 1, in which said piece of cloth is formed from one of cotton fiber, silk fiber, hemp yarn, artificial silk fiber, nylon fiber, polyester fiber, a commingle yarn of nylon and polyester, non-woven hygroscopic fabric and paper.

8. The swab as set forth in claim 1, in which said coupling member is implemented by a deformable tube member, and said deformable tube member presses said leading end portion of said piece of hygroscopic material against an outer surface of said trailing end portion of said flexible guide member.

9. The swab as set forth in claim 1, in which said tube-like configuration is increased in inner diameter from one end thereof to an intermediate point, and is decreased in said inner diameter from said intermediate point to the other end thereof.

10. The swab as set forth in claim 9, in which said tube-like configuration is a generally isosceles triangle when said tube-like configuration is collapsed.

11. The swab as set forth in claim 10, in which said generally isosceles triangle has a ratio of base to height ranging between 5:1 to 30:1.

* * * * *